US010328487B2

(12) United States Patent
Wang et al.

(10) Patent No.: US 10,328,487 B2
(45) Date of Patent: Jun. 25, 2019

(54) LOW-PRESSURE CAST ALUMINUM WHEEL MOLD

(71) Applicant: CITIC Dicastal CO., LTD., Qinhuangdao (CN)

(72) Inventors: Kaiqing Wang, Qinhuangdao (CN); Hongbiao Li, Qinhuangdao (CN); Xu Wang, Qinhuangdao (CN); Changhai Li, Qinhuangdao (CN); Yongwang Zhao, Qinhuangdao (CN); Honghai Zhou, Qinhuangdao (CN)

(73) Assignee: CITIC DICASTAL CO., LTD. (CN)

( * ) Notice: Subject to any disclaimer, the term of this patent is extended or adjusted under 35 U.S.C. 154(b) by 0 days.

(21) Appl. No.: 15/596,279

(22) Filed: May 16, 2017

(65) Prior Publication Data

US 2018/0264540 A1 Sep. 20, 2018

(30) Foreign Application Priority Data

Mar. 19, 2017 (CN) ..... 2017 1 0163274

(51) Int. Cl.
*B22C 9/28* (2006.01)
*B22D 18/04* (2006.01)
*B22C 9/06* (2006.01)

(52) U.S. Cl.
CPC ..... *B22C 9/28* (2013.01); *B22C 9/065* (2013.01); *B22D 18/04* (2013.01)

(58) Field of Classification Search
CPC ..... B22C 9/06; B22C 9/28; B22D 18/04
See application file for complete search history.

(56) References Cited

U.S. PATENT DOCUMENTS 5,314,001 A * 5/1994 Hidaka ..... B22C 9/28 164/119
2004/0134636 A1* 7/2004 Aoki ..... B22C 9/28 164/306
2016/0368043 A1* 12/2016 Zhou ..... B22C 9/28
2018/0001373 A1* 1/2018 Liu ..... B22C 9/065

FOREIGN PATENT DOCUMENTS

CN 203565824 U * 4/2014
CN 203875309 U * 10/2014

* cited by examiner

*Primary Examiner* — Kevin E Yoon
(74) *Attorney, Agent, or Firm* — Weintraub Tobin; Zheng "Andy" Liu

(57) ABSTRACT

The present disclosure provides a low-pressure cast aluminum wheel mold. The back cavity of a top mold (1) is divided into three parts: the back cavity in a rim area is open, and the wall thickness of the top mold is progressively increased by 15-25 mm from bottom to top; the back cavity in a spoke area is machined in a profile-followed manner, and the top mold has an equal wall thickness of 20-30 mm; at each R angle position where the rim is connected with a spoke, the top mold is provided with a boss (11), the axial wall thickness of the boss (11) is 40-60 mm, and the radial wall thickness is 30-50 mm. A temperature gradient beneficial to progressive solidification of a casting is constructed; by designing an annular water cooling structure at the R angle where the rim is connected with the spoke, quick cooling on the hot spot is specifically realized, the cooling capability is stronger, the cooling range is more exact, bad influence on the adjacent thin-wall part is not produced, and smooth feeding of molten aluminum is ensured.

3 Claims, 2 Drawing Sheets

LOW-PRESSURE CAST ALUMINUM WHEEL MOLD

RELATED APPLICATION

This application claims priority to Chinese Patent Application No. 201710163274.6, filed on Mar. 19, 2017, which is hereby incorporated by reference in its entirety.

TECHNICAL FIELD

The present disclosure relates to a casting mold, and specifically to a mold for eliminating the defects at R angle hot spot positions of a low-pressure cast aluminum wheel.

BACKGROUND

Requirements for both appearance and safe should be considered for aluminum wheels, putting forward a great challenge to wheel manufacturers. At the present stage, about 80% of aluminum wheels are produced by adopting a low-pressure cast molding process, which adopts a central injecting from bottom mode that high-temperature molten aluminum is driven by external pressure to enter a mold and solidified in a cavity to form a qualified casting having dimension and performance both meeting standards. As for wheel molding, junction R angles of the spokes and the rim are quite thick and large, belong to typical casting hot spots, and are also difficult and important in present production. A large number of practices show that rejects caused by R angle position defects account for over 70% of the total proportion, mainly because the wall of the casting therein is thick and heat is too concentrated therein, causing slow solidification of molten aluminum, whereas the front spoke wall is relatively thin, and the molten aluminum is quickly solidified to block a molten aluminum flow channel early, thereby hindering effective feeding on the hot spots and leading to molding defects such as loosening, shrinkage and the like; besides, relatively low degree of super cooling may result in thick and large grains and loose tissues of the casting, so that the mechanical properties are low, the wheel is difficult in passing subsequent reliability test, and the safety performance of the wheel is influenced. Meanwhile, the long solidification process prolongs the production cycle, improves the production cost and is unbeneficial to benign development of enterprises. Therefore, how to solve the molding problem of R angle positions is a puzzle for numerous wheel technologists.

SUMMARY

The present disclosure is aimed at providing a low-pressure cast aluminum wheel mold, which can specifically strengthen the cooling strength of hot spots at R angle positions and construct a mold temperature distribution beneficial to progressive solidification of a wheel, thereby solving the defects easily occurring in production, such as loosening, shrinkage, low mechanical properties and the like, improving the yield, shortening the process cycle, reducing the manufacturing cost of enterprises and realizing efficient production of wheels.

The technical solution in the present disclosure is that a low-pressure cast aluminum wheel mold includes a top mold, a side mold, a bottom mold, water pipe connectors, a cover plate, a division plate and heat insulation asbestos.

The back cavity of the top mold is divided into three parts: the back cavity in a rim area presents a ringent shape, and the wall thickness of the top mold is progressively increased by 15-25 mm from lower to upper; the back cavity in a spoke area is machined in a profile-followed manner, and the top mold has an equal wall thickness of 20-30 mm; and at each R angle position where the rim is connected with a spoke, the top mold is provided with a boss, the axial wall thickness of the boss is 40-60 mm, and the radial wall thickness is 30-50 mm.

The top of the boss is a plane, the side is a conical surface, and the top and side of the boss smoothly transit to adjacent parts respectively with fillets. An annular water channel having a U-shaped section is provided on the boss, and the middle of the annular water channel is divided into two parts by the division plate. The division plate is composed of two metal sheets having L-shaped sections, and is close to one side of the spokes, thus weakening cooling inside the spokes. The cover plate is arranged on the annular water channel, and the cover plate is welded and sealed on the annular water channel to avoid water leak.

The cover plate on the annular water channel is provided with water holes on which water inlet pipe connectors and water outlet pipe connectors are welded; the water inlet pipe connectors and the water outlet pipe connectors are two in and two out, and are distributed symmetrically in a 180° crossing manner to ensure the cooling uniformity; and the water pipe connectors are all made of stainless steel, thus reducing the risk of corrosion and prolonging the service life.

A boss is formed at the hot spot R angle where the rim is connected with the spoke, and an upper heat insulation slot is formed at the lower end of the rim above the boss, perpendicular to the profile of the rim and stuffed with the heat insulation asbestos; a lower heat insulation slot is formed at the tail end of the spoke below the boss, perpendicular to the spoke and stuffed with the heat insulation asbestos.

After wheel casting begins, solidification and crystallization are generally completed within 40-60 s at the rim and the part above, then cooling at the R angle positions begins and ends within 20-30 s before pressure maintenance ends, the flow rate of cooling water is generally set to 200-300 L/h, the water temperature is about 30° C., and heat concentrated at the thick and large hot spots is taken away by high-speed circulation of the cooling water in the water channel, so that quick solidification and crystallization of high-temperature molten aluminum are realized; and stable and smooth production of wheel castings can be realized according to the above process.

In the present disclosure, the top mold of the mold and the cooling device are improved, and a temperature gradient beneficial to progressive solidification of a casting is constructed by segmenting the wall thickness. By designing the annular water cooling device at the R angle where the rim is connected with the spoke, quick cooling on the hot spot is specifically realized, the cooling capability is stronger, the cooling range is more exact, bad influence on the adjacent thin-wall part is not produced, and smooth feeding of molten aluminum is ensured; the defects easily occurring at the hot spot, such as loosening, shrinkage, low mechanical properties and the like, are eliminated, and the safety performance of the wheel is greatly improved while the yield is improved; moreover, the process cycle of a single piece is obviously shortened, thus improving the production efficiency and reducing the production cost of enterprises.

In which: 1—top mold, 11—boss, 12—annular water channel, 13—upper heat insulation slot, 14—lower heat insulation slot, 15—water channel partition, 2—side mold, 3—bottom mold, 4—water pipe connector, 41—water inlet pipe connector, 42—water outlet pipe connector, 5—cover plate, 51—circular water hole, 6—division plate, 7—heat insulation asbestos.

DETAILED DESCRIPTION OF THE EMBODIMENTS

Figure 1:
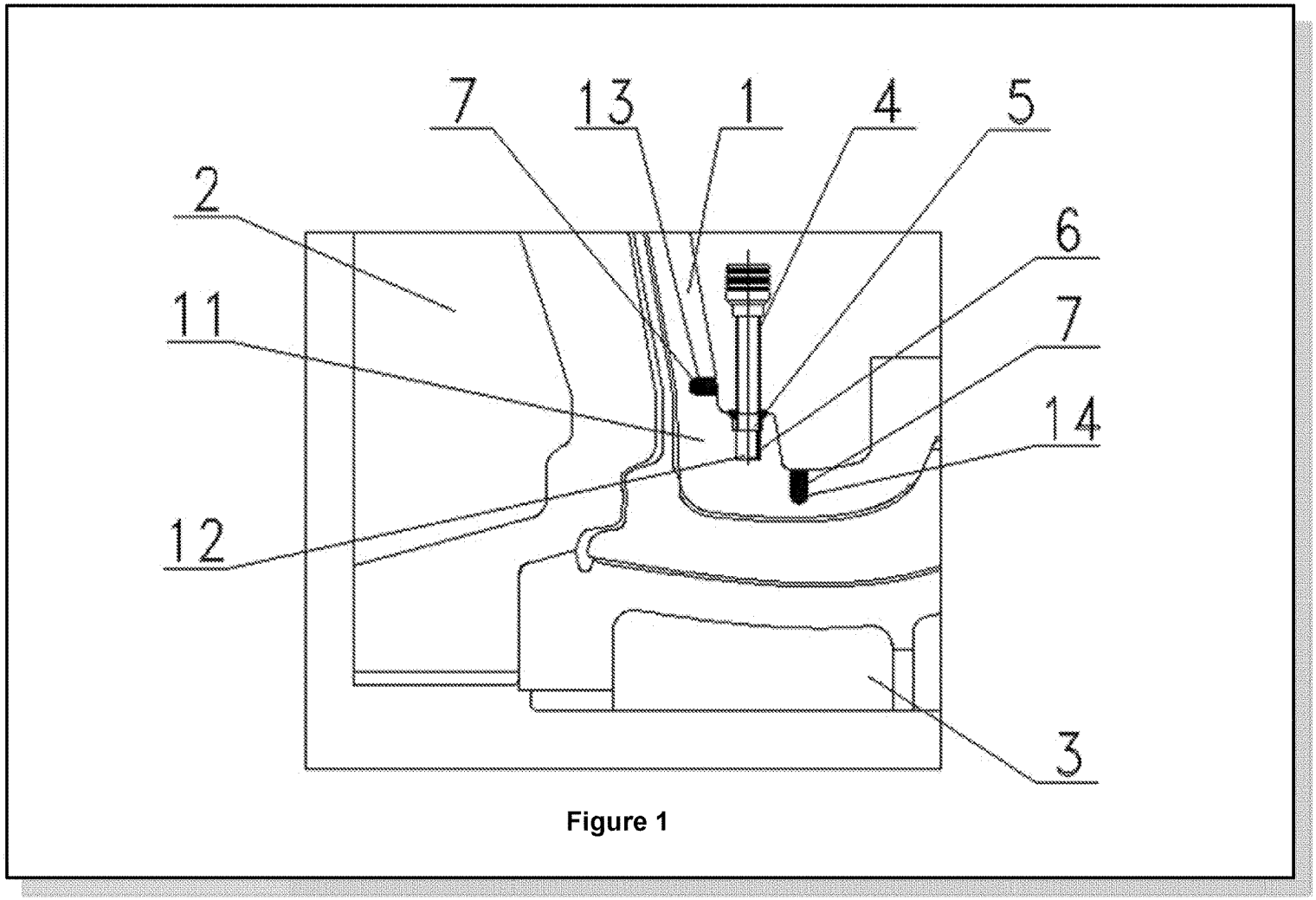
FIG. 1 is a schematic assembly diagram of a novel low-pressure cast wheel mold in the present disclosure.
Figure 2:
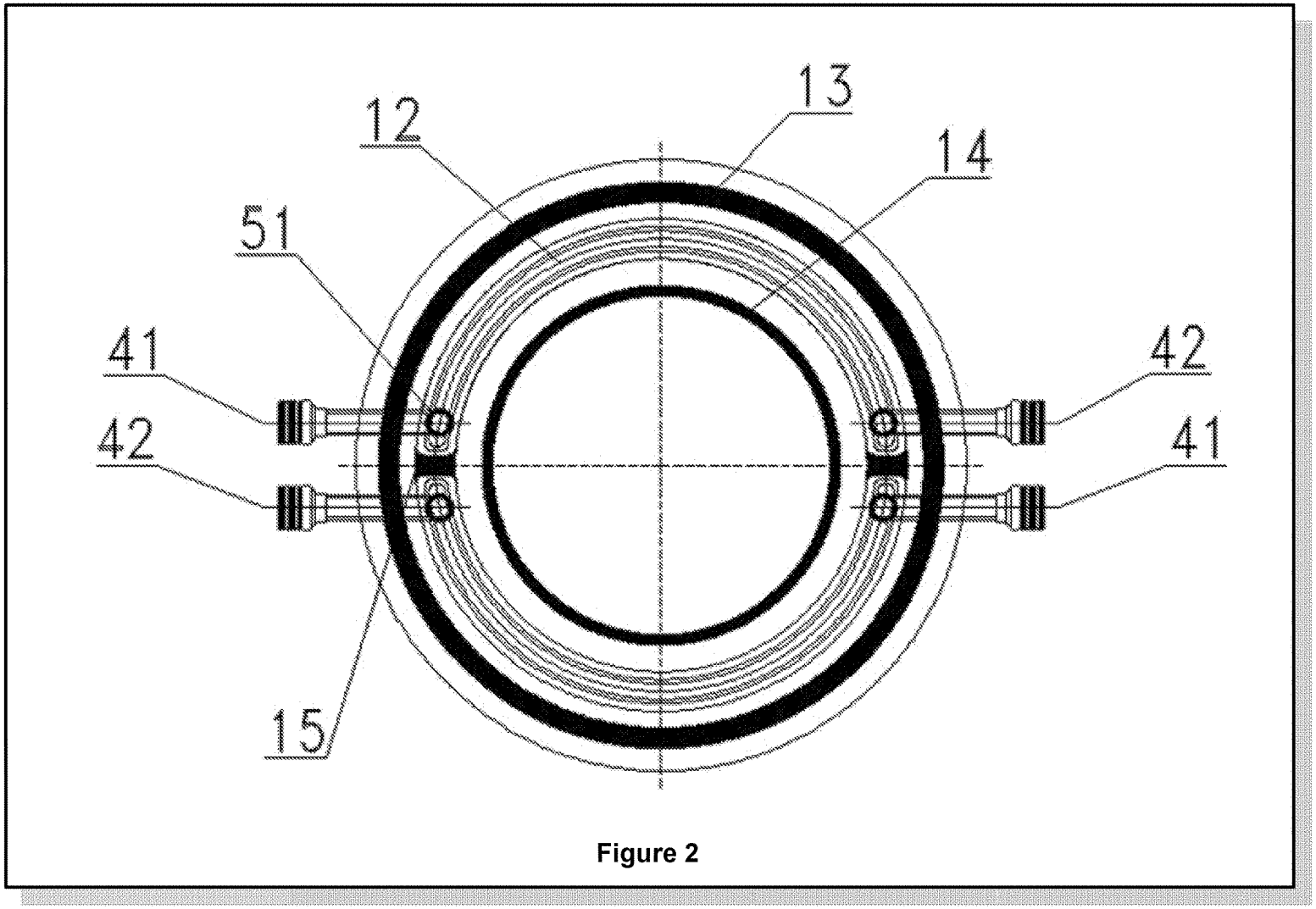
FIG. 2 is a structural schematic diagram of an R angle position cooling structure of a top mold in the present disclosure.

As shown in FIGS. 1 and 2, a low-pressure cast aluminum wheel mold includes a top mold 1, a side mold 2, a bottom mold 3, water pipe connectors 4, a cover plate 5, a division plate 6 and heat insulation asbestos 7.

The back cavity of the top mold 1 is divided into three parts: the back cavity in a rim area presents a ringent shape, and the wall thickness of the top mold is progressively increased by 15-25 mm from lower to upper; the back cavity in a spoke area is machined in a profile-followed manner, and the top mold has an equal wall thickness of 20-30 mm; at each R angle position where the rim is connected with a spoke, the top mold is provided with a boss 11, the axial wall thickness of the boss 11 is 40-60 mm, and the radial wall thickness is 30-50 mm.

The top of the boss 11 is a plane with the width of 15-20 mm, the side of the boss is a conical surface and the side and the axial direction form an included angle of 5-10°; the boss smoothly transit to an adjacent part, and the size of the fillet is R 5-10 mm; on the boss 11 is provided an annular water channel 12, having a U-shaped section, a size of 8×12 mm and a root of R 2-5 mm, to eliminate stress concentration; the annular water channel 12 is composed of two parts, two water channel partitions 15 are arranged in the middle, and the water channel partitions 15 have a thickness more than 10 mm, thus reducing the cracking risk; a division plate 6 is arranged on the annular water channel 12, the division plate 6 has an L-shaped section and a thickness of 2 mm, and the division plate 6 is placed on one side, close to the spoke, of the water channel 12 and connected firmly by spot welding, so that the cooling range can be controlled to the R angle side.

The cover plate 5 is arranged on the annular water channel 12, the cover plate 5 is welded and sealed with the annular water channel 12, and a strict welding process flow shall be formulated to avoid seam cracking and water leak.

The cover plate 5 is provided with four circular water holes 51 at two ends, and the sizes of the circular water holes 51 are φ 14 mm; the water pipe connectors 4 made of stainless steel are welded on the four circular water holes 51 respectively; the cooling pipeline is designed in a two in and two out form, a water inlet pipe connector 41 and a water outlet pipe connector 42 are arranged on single side in a 180° crossing manner to ensure a more uniform cooling effect; and the water pipe connectors 4 are connected with external cooling water storage equipment, thus forming two closed cooling water circulating channels.

Upper heat insulation slots a 13 are formed on the upper sides of the bosses 11, perpendicular to the side wall of the rim and distributed circumferentially along the back cavity, the widths of the heat insulation slots a are 6-8 mm, and the roots of the heat insulation slots a are spaced more than 10 mm from the cavity surface, so that enough mold strength is ensured; the upper heat insulation slots a 13 are stuffed with the heat insulation asbestos 7 to realize a better heat insulation effect; lower heat insulation slots b 14 are formed at the lower roots of the bosses 11, perpendicular to spokes and distributed circumferentially, the widths of the heat insulation slots b 14 are 6-8 mm, the roots of the heat insulation slots b 14 are spaced more than 10 mm from the profile, and the slots stuffed with the heat insulation asbestos; the two heat insulation slots are designed to define cooling at thick-wall R angle positions, thus realizing forced cooling without influencing the temperature distribution of the adjacent thin-wall part, and ensuring more exact cooling.

After wheel casting begins, solidification and crystallization are generally completed within 40-60 s at the rim and the part above, and then cooling at the R angle positions begins and ends within 20-30 s before pressure maintenance ends; the flow rate of cooling water is 200-300 L/h, the temperature of the cooling water is 25-30□, and stable and smooth production of wheel castings can be realized according to the above process. Heat concentrated at the thick and large hot spots is taken away by high-speed circulation of the cooling water in the water channel, so that quick solidification of high-temperature molten aluminum is realized, the defects easily occurring, such as loosening, shrinkage and the like, are eliminated, the mechanical properties are obviously improved, and the comprehensive quality and yield of the product are improved.

In the present disclosure, a temperature gradient beneficial to progressive solidification of a casting is constructed from the perspective of self-heat transfer of the mold by segmenting the wall thickness of the top mold; by designing the annular water cooling structure at the R angle where the rim is connected with the spoke, quick cooling on the hot spot is specifically realized, the cooling capability is stronger, the cooling range is more exact, bad influence on the adjacent thin-wall part is not produced, and smooth feeding of molten aluminum is ensured; the defects easily occurring at the hot spot, such as loosening, shrinkage, low mechanical properties and the like, are eliminated, and the safety performance of the wheel is greatly improved while the yield is improved; moreover, the process cycle of a single piece is obviously shortened, thus improving the production efficiency and reducing the production cost of enterprises.

The invention claimed is:

1. A low pressure cast aluminum wheel mold, comprising a top mold, a side mold, a bottom mold, water pipe connectors, a cover plate, a division plate and heat insulation asbestos, is characterized in that a first back cavity of the top mold is divided into three parts: a second back cavity in a spoke area is machined in a profile-followed manner, and the top mold has an equal wall thickness of 20-30 mm; and at each R angle position where the rim is connected with a spoke, the top mold is provided with a boss, a axial wall thickness of the boss is 40-60 mm, and a radial wall thickness is 30-50 mm.

2. The low-pressure cast aluminum wheel mold of claim 1, wherein the top of the boss is a plane, the side is a conical surface, and the top and side of the boss smoothly transit to adjacent parts respectively with fillets; an annular water channel having a U-shaped section is provided on the boss, the middle of the annular water channel is divided into two parts by the division plate, and the division plate is composed of two metal sheets having L-shaped sections and is close to one side of the spokes; the cover plate is arranged on the annular water channel, the cover plate is welded and sealed on the annular water channel, and the cover plate is provided with water holes on which water inlet pipe connectors and water outlet pipe connectors are welded; the water inlet pipe connectors and the water outlet pipe connectors are two in and two out, and are distributed symmetrically in a 180° crossing manner; an upper heat insulation slot is formed at the lower end of the rim above the boss, perpendicular to the profile of the rim and stuffed with the heat insulation asbestos; a lower heat insulation slot is formed at the tail end of the spoke below the boss, perpendicular to the spoke and stuffed with the heat insulation asbestos.

3. The low-pressure cast aluminum wheel mold of claim 2, wherein the width of the top of the boss is 15-20 mm, and the side of the boss and the axial direction form an included angle of 5-10°; the size of a transition fillet between the boss and an adjacent part is set to R 5-10 mm; on the boss 11 is provided a U-shaped annular water channel 12, having a width of 8 mm, a height of 12 mm and a root of R 2-5 mm; the thicknesses of water channel partitions 15 are more than 10 mm, the thickness of the division plate is 2 mm, the diameters of the circular water holes 51 are 14 mm, the width of the heat insulation slot a is 6-8 mm, the root of the heat insulation slot a is spaced more than 10 mm from the cavity surface, the width of the heat insulation slot b 14 is 6-8 mm, and the root of the heat insulation slot b 14 is spaced more than 10 mm from the profile.

* * * * *